US006040816A

United States Patent [19]

Uchino

[11] Patent Number: 6,040,816

[45] Date of Patent: Mar. 21, 2000

[54] ACTIVE MATRIX DISPLAY DEVICE WITH PHASE-ADJUSTED SAMPLING PULSES

[75] Inventor: Katsuhide Uchino, Kanagawa, Japan

[73] Assignee: Sony Corporation, Japan

[21] Appl. No.: 08/964,012

[22] Filed: Nov. 4, 1997

[30] Foreign Application Priority Data

Nov. 8, 1996 [JP] Japan ..... P08-296045

[51] Int. Cl.[7] ..... G09G 3/36

[52] U.S. Cl. ..... 345/99; 345/94; 345/208; 345/213

[58] Field of Search ..... 345/87, 92, 94, 345/98, 99, 100, 208, 213

[56] References Cited

U.S. PATENT DOCUMENTS

| | | | |
|---|---|---|---|
| 5,369,417 | 11/1994 | Tanaka | 345/98 |
| 5,654,735 | 8/1997 | Nakajima | 345/99 |
| 5,841,430 | 11/1998 | Kurikko | 345/99 |
| 5,859,626 | 1/1999 | Kawamura | 345/99 |

FOREIGN PATENT DOCUMENTS

| | | |
|---|---|---|
| 0553 823A2 | 8/1993 | European Pat. Off. . |
| 6/348232 | 12/1994 | Japan . |
| 8/286640 | 1/1996 | Japan . |

*Primary Examiner*—Bipin Shalwala
*Assistant Examiner*—Kent Chang
*Attorney, Agent, or Firm*—Rader, Fishman & Grauer; Ronald P. Kananen

[57] ABSTRACT

An active matrix display device including a pixel unit which includes row-type gate lines, column-type signal lines and pixels arranged at respective intersecting portions of the gate lines and the signal lines. A vertical scan circuit that successively scans the gate lines to select one row every horizontal period. A horizontal scan circuit supplies video signals to the signal lines. A shift register operates in accordance with a primary clock signal to successively output primary sampling pulses. A phase adjusting unit performs phase adjustment on the primary sampling pulse in accordance with a secondary clock signal to output phase-adjusted pulses which are the primary sampling pulses after the phase adjustment.

16 Claims, 10 Drawing Sheets

ACTIVE MATRIX DISPLAY DEVICE WITH PHASE-ADJUSTED SAMPLING PULSES

BACKGROUND OF THE INVENTION

1. Field of the Invention

The present invention relates to an active matrix display device, and particularly to an active matrix display device which includes a pixel unit comprising row-type gate lines, column-type signal lines and pixels arranged at respective intersecting portions of the row-type gate lines and the column-type signal lines, a vertical scan circuit for successively scanning the gate lines on a line basis to select pixels of one row every horizontal period, and a horizontal scan circuit for supplying video signals to the signal lines within one horizontal period and successively writing the video signals in the selected pixels of one row.

2. Description of the Related Art

A liquid crystal display has advantages in that it can be easily designed to be thin, power consumption is low and it can be easily designed to have a color display. It is widely used for a display screen of OA equipment or the like. Further, an active matrix liquid crystal display (AM-LCD: Active Matrix-Liquid Crystal Display) has been recently mainly used. In the active matrix liquid crystal display, switches such as a transistor, a diode, etc. which are used to apply a voltage are arranged on each display dot, and it is excellent in contrast, response speed, and color purity.

FIG. 1 is a diagram showing an active matrix liquid crystal display. The active matrix liquid crystal display includes gate lines G arranged on rows, signal lines S1, S2, S3, . . . arranged on columns, and matrix-arranged pixels PXL which are arranged at the intersecting portions of the gate lines and the signal lines.

Each pixel PXL is driven by a switching element which comprises a thin film transistor Tr, etc. The gate electrode of the thin film transistor Tr is connected to the corresponding gate line G, the source electrode is connected to the corresponding signal line S, and the drain electrode is connected to the corresponding pixel PXL.

The active matrix liquid crystal display contains a vertical scan circuit 10 and a horizontal scan circuit 20 in addition to the pixel PXL, etc. The vertical scan circuit 10 successively scans the respective gate lines G on a line by line basis, and selects pixels PXL of one row every horizontal period. That is, the vertical scan circuit 10 outputs a selected pulse to each gate line G every horizontal period to set the thin film transistor Tr on the same line to a conductive state.

Further, the horizontal scan circuit 20 successively samples the video signals from a video line to each signal line S1, S2, S3, . . . within one horizontal period to successively write the video signals into the selected pixels PXL of one row on a point basis. The horizontal scan circuit 20 has a shift register 20*a* comprising multistage-connected flip-flops FF.

The shift register 20*a* is actuated in accordance with a pair of horizontal clocks HCK, HCKX which are supplied from externally and have opposite phases to each other, and it successively transfers horizontal start signals HST supplied from externally to output sampling pulses A1, A2, A3, . . . every stage. On the basis of the sampling pulse A1, A2, A3, . . . , final sampling pulses B1, B2, B3, . . . are obtained through logic circuits 70*a*, 70*b*, 70*c*, . . . for waveform shaping.

The signal lines S1, S2, S3, . . . are connected to horizontal switches HSW1, HSW2, HSW3, . . . , respectively, and receive the incoming video signals through the common video line. The respective horizontal switches HSW1, HSW2, HSW3, . . . successively carry out the switching operation thereof in accordance with the corresponding sampling pulses B1, B2, B3, . . . respectively, and successively sample the video signals to the corresponding signal lines S1, S2, S3, . . .

FIG. 2 is a timing chart showing the operation of the active matrix liquid crystal display. The horizontal start signal HST is one-pulse. On the other hand, the horizontal clock signals HCK and HCKX are rectangular waves which are opposite in phase to each other. In accordance with these clock signals, the shift register 20*a* operates to successively transfer HST and successively output the sampling pulses A1, A2, A3, . . .

These sampling pulses A1, A2, A3, . . . are subjected to the waveform shaping by the logical circuits 70*a*, 70*b*, 70*c*, . . . which are provided at the respective stages of the shift register 20*a*, thereby obtaining the final sampling pulses B1, B2, B3, . . . which are timely separated from one another.

The horizontal switches HSW1, HSW2, HSW3, . . . successively carry out the switching operation in accordance with the sampling pulses B1, B2, B3, . . . to sample the video signals to the signal lines.

Accordingly, in order to set the voltage level of the video signal to the pixel PXL, it is necessary that the sampling pulses B1, B2, B3, . . . and the incoming video signals are matched with each other in phase.

However, the active matrix liquid crystal display has some dispersion between elements in a manufacturing process. Further, in the process of generating the sampling pulses B1, B2, B3, . . . a time delay accurst during a period from the leading (trailing) edge of HCK and HCKX until the output time of the sampling pulses A1, A2, A3, . . . from the shift register 20*a*, and until passing through the logical circuits 70*a*, 70*b*, 70*c*, . . . Accordingly, the phases of the sampling pulses B1, B2, B3, . . . are dispersed.

Therefore, the sampling is performed with a time lag from the original time at which the sampling must be originally performed, resulting in reduction of resolution and occurrence of ghost images. Accordingly, it is necessary to suppress the dispersion of phase among the sampling pulses.

FIG. 3 is a schematic diagram showing an active matrix liquid crystal display which eliminates the phase dispersion of the sampling pulses in the prior art. The basic construction is the same as the active matrix liquid crystal display as shown in FIG. 1, and it includes gate lines G arranged on rows, signal lines S arranged on columns and pixels PXL arranged in a matrix form at the respective intersecting portions of the gate lines and the signal lines. Further, it contains a vertical scan circuit 10 to successively scan the gate lines G on a line basis and select pixels PXL of one row every horizontal period. Further, it contains a horizontal scan circuit 20 to supply the video signals to the respective signal lines within one horizontal period and successively write the video signals in the selected pixels PXL of one row on a point basis.

Further, as a characteristic construction, a clock switch CKSW is provided to the output of the shift register 20*a*. CKSW performs its switching operation in accordance with a sampling pulse A which is connected to the shift register 20*a*, and samples CK, CKX which are the same as or different from HCK, HCKX, thereby generating sampling pulses B.

The horizontal switch HSW is connected to one end of each signal line S, and performs the switching operation in accordance with the sampling pulse B to successively sample the video signals input to the signal lines.

FIG. 4 is a timing chart showing the operation of the active matrix liquid crystal display which eliminates the phase dispersion of the sampling pulses. The horizontal start signal a one-shot pulse. On the other hand, the horizontal clock signals HCK, HCKX are rectangular waves which are opposite in phase to each other, and the shift register 20*a* is operated in accordance with these signals to successively transfer HST and output the sampling pulse A.

CK and CKX are rectangular waves which are opposite in phase to each other. HCK and CK, and HCKX and CKX have the same waveform, and they may be commonly used. CKSW performs the switching operation in accordance with the sampling pulse A to pick up one or plural CKX pulses or CK pulses contained in the sampling pulse A. In the figure, one CKX pulse contained in the sampling pulse A is picked up to generate the sampling pulse B.

As described above, the sampling pulse B to drive HSW is picked up from the original clock signal CK or CKX, so that the dispersion thereof is less than the sampling pulse A.

However, in the above-described prior art, when the sampling pulse A which is an output of the shift register 20*a* and CKX are deviated from each other in phase, dispersion occurs in phase between the sampling pulses B.

FIG. 5 is a timing chart showing occurrence of phase dispersion of the sampling pulses B. The sampling pulse A and CKX are deviated in phase by t.

The sampling pulse B is taken out as the CKX pulse contained in the sampling pulse A, so that when the sampling pulse A is off as shown in the figure, the sampling pulse B is also off.

Accordingly, when the sampling pulse A is dispersed, the sampling pulse B is also dispersed in phase. This phase dispersion induces reduction of resolution, ghost, etc.

SUMARY OF THE INVENTION

The present invention has been implemented in view of the foregoing point, and has an object to provide an active matrix display device for suppressing the phase dispersion of sampling pulses to drive a horizontal switch.

In order to attain the above object, an active matrix display device according to the present invention includes a pixel unit which comprises row-type gate lines, column-type signal lines and pixels which are arranged at respective intersecting portions of the row-type gate lines and the column-type signal lines, a vertical scan circuit for successively scanning the gate lines on a line basis to select pixels of one row every horizontal period, a horizontal scan circuit for supplying video signals to the signal lines within one horizontal period and successively writing the video signals in the selected pixels of one row, the horizontal scan circuit having a shift register which operates in accordance with a primary clock signal to successively output primary sampling pulses, a phase adjusting unit for performing phase adjustment on the primary sampling pulse to a secondary clock signal to output phase-adjusted pulses which are the primary sampling pulses after the phase adjustment, a primary switch group which is connected to each of the output stages of the phase adjusting unit and performs a switching operation in accordance with the phase-adjusted pulses to sample the primary clock signals or the secondary clock signals and successively generate primary sampling pulses, and a secondary switch group which is connected to one end of each of the signal lines and performs a switching operation in accordance with the secondary sampling pulses to supply the video signals input from the external to the signals lines.

Here, the secondary clock signals may be the same as or different from the primary clock signals.

Further, the pixel unit, the horizontal scan circuit, the phase adjustment unit and the primary and secondary switch groups may be formed on the same substrate, and/or the pixel unit and the vertical scan circuit may be formed on the same substrate.

Still further, the horizontal scan circuit, the phase adjustment unit and the primary and secondary switch groups may be constructed by thin film transistors which are formed on an insulating substrate.

In the active matrix display device described above, the write-in operation of the video signals may be successively performed on a point basis.

Further, each of the pixels may have a pixel transistor which is connected to a pixel electrode.

In addition, the pixel transistor may be formed of a thin film transistor which is formed on an insulating substrate.

DETAILED DESCRIPTION OF THE PREFERRED EMBODIMENT

An embodiment of the present invention will be described with reference to the accompanying drawings.

Figure 1:
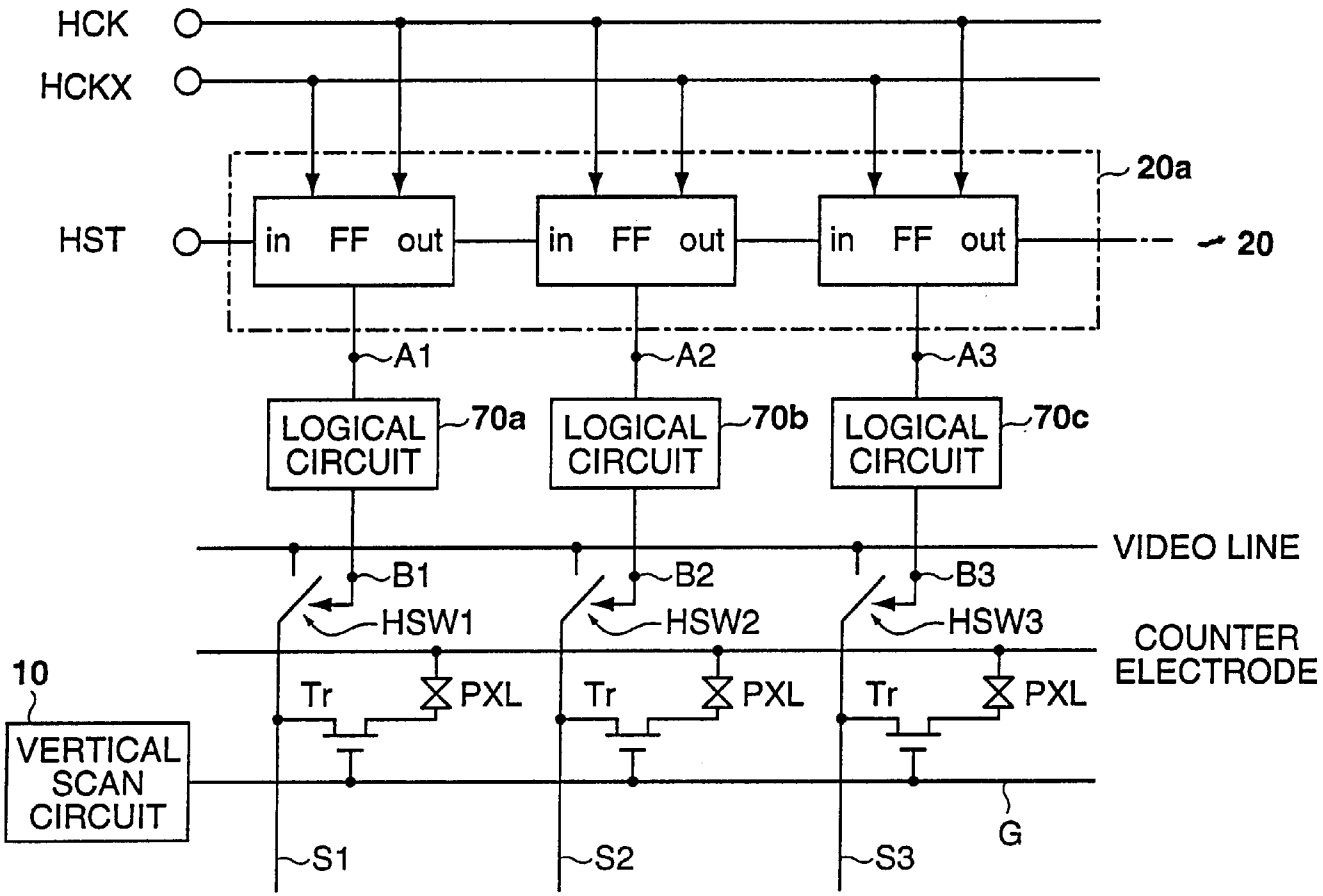
FIG. 1 is a diagram showing an active matrix liquid crystal display.
Figure 2:
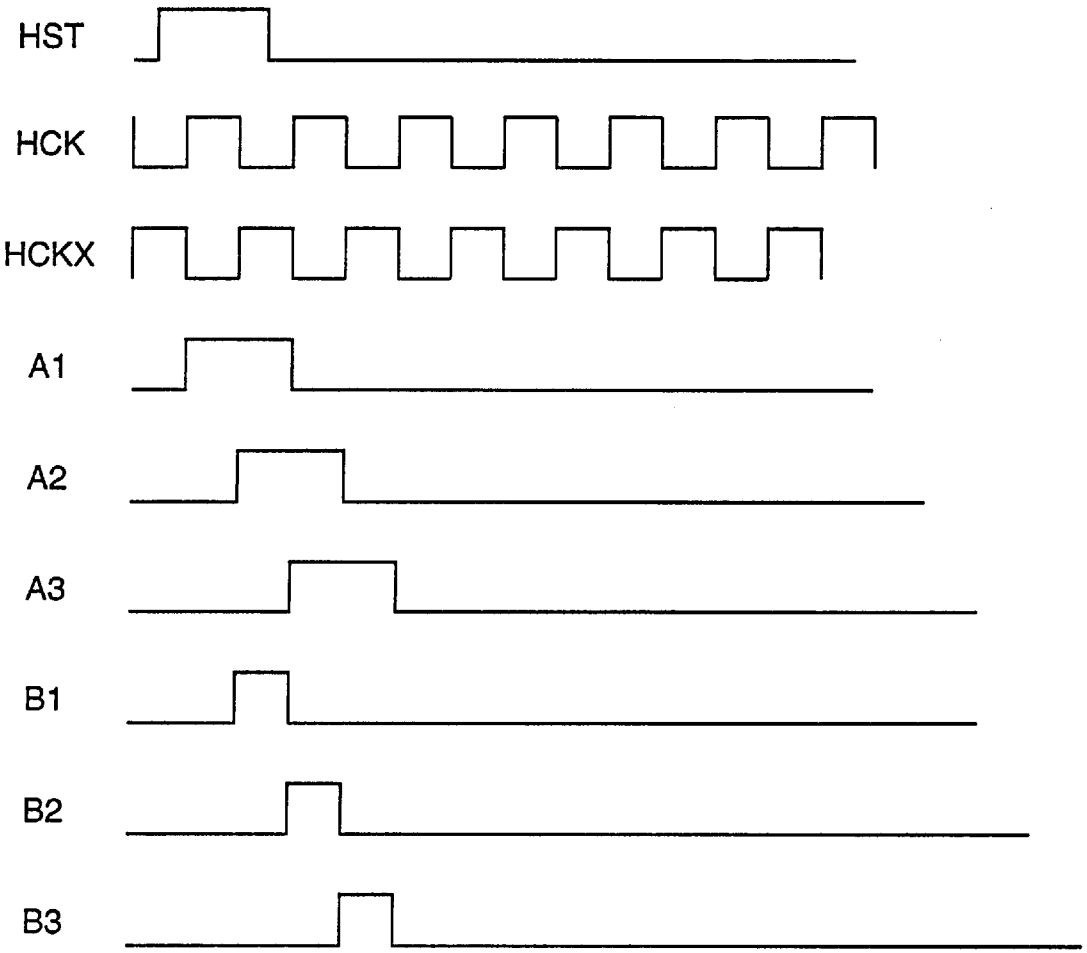
FIG. 2 is a timing chart showing the operation of the active matrix liquid crystal display.
Figure 3:
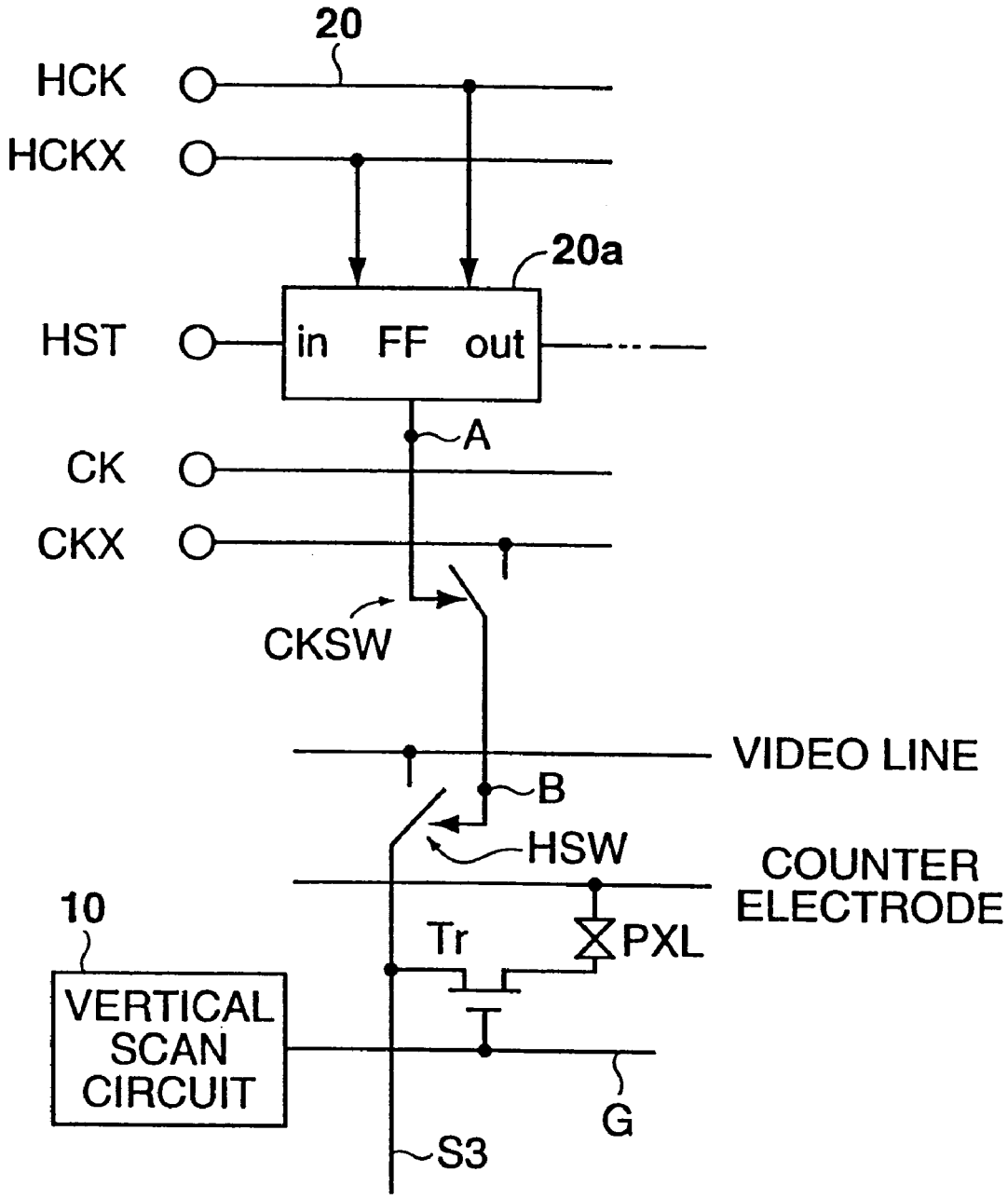
FIG. 3 is a diagram showing the construction of a conventional active matrix liquid crystal display which eliminates the phase dispersion of sampling pulses.
Figure 4:
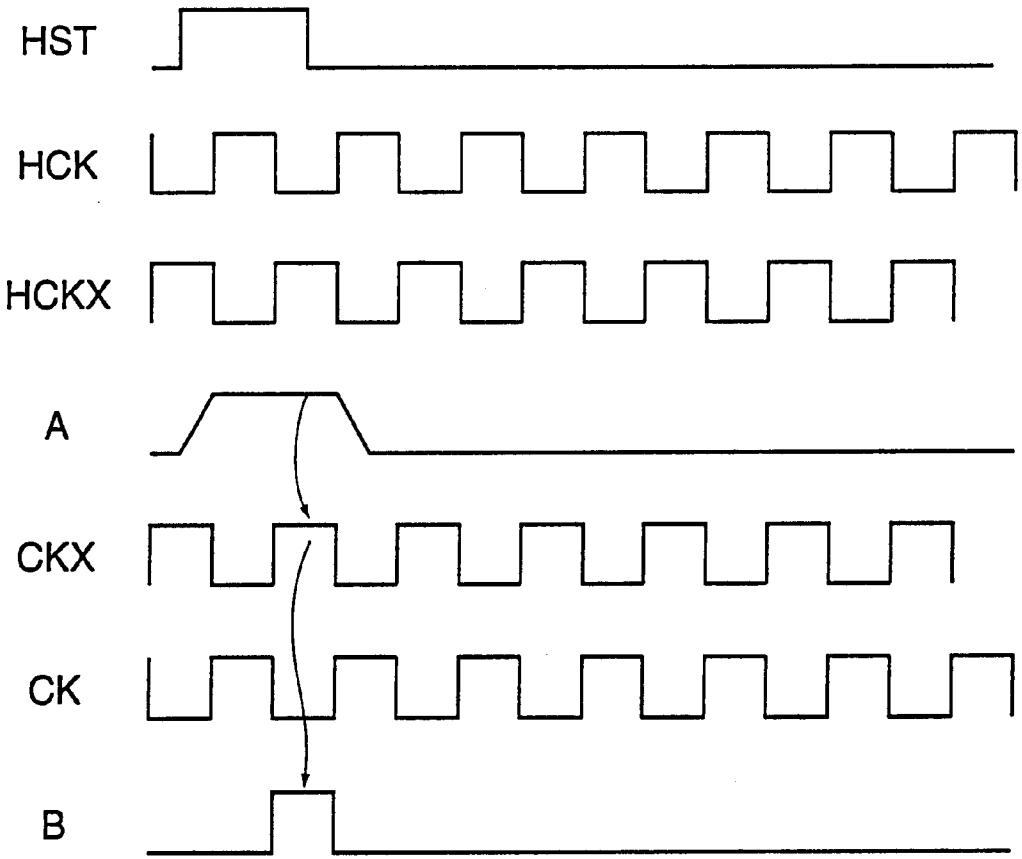
FIG. 4 is a timing chart showing the operation of an active matrix liquid crystal display which eliminates the phase dispersion of sampling pulses.
Figure 5:
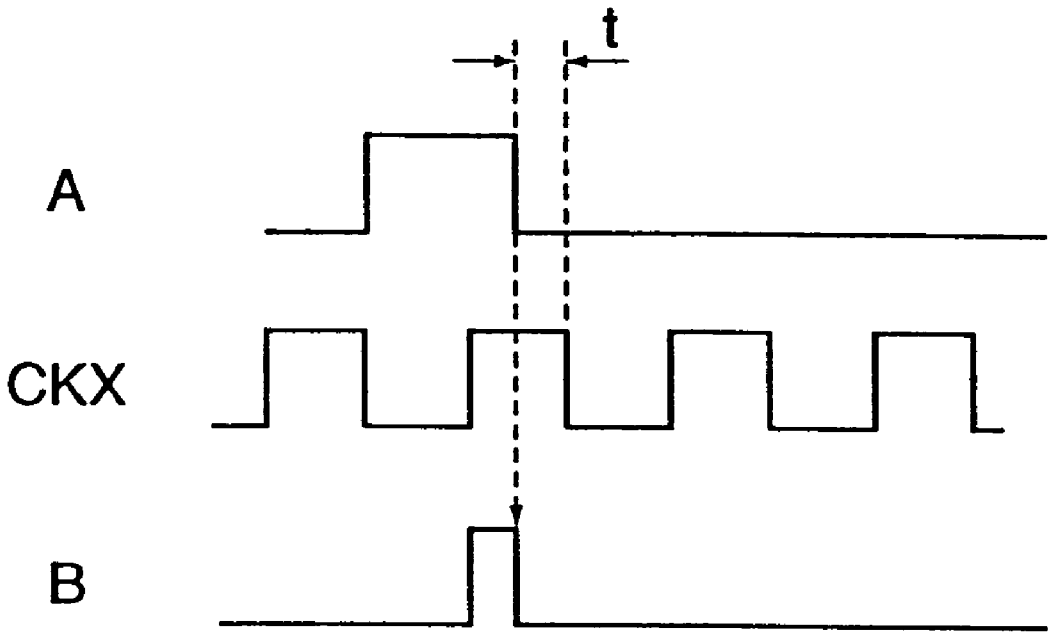
FIG. 5 is a timing chart showing occurrence of the phase dispersion of sampling pulses B.
Figure 6:
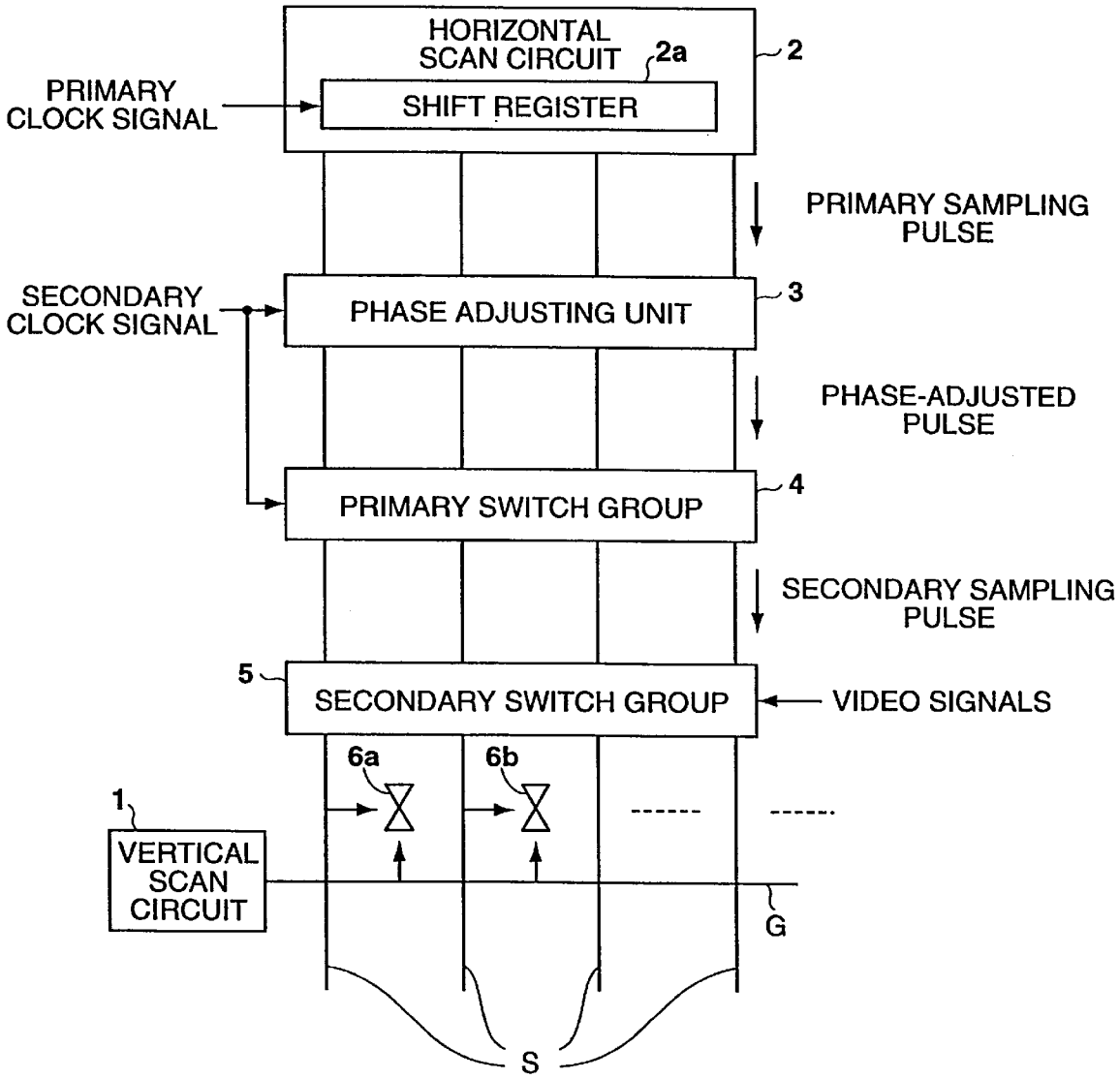
FIG. 6 is a diagram showing the principle of an active matrix display device according to the present invention.

FIG. 6 is a diagram showing a diagram showing the principle of an active matrix display device according to the present invention. The active matrix display device includes gate lines G arranged on rows, signal lines S arranged on columns and matrix-arranged pixels 6*a*, 6*b*, . . . which are arranged at the respective intersecting portions between the gate lines and the signal lines. A vertical scan circuit 1 scans the gate lines G successively on a line basis to select pixels 6*a*, 6*b*, . . . of one row every horizontal period. A horizontal scan circuit 2 supplies video signals to the signal lines S within one horizontal period and writes the video signal in the selected pixels 6*a*, 6*b*, . . . of one row successively on a point basis.

A shift register 2*a* is provided in the horizontal scan circuit 2, and operates in accordance with a primary clock signal to successively output primary sampling pulses. A phase adjusting unit 3 performs phase adjustment of the primary sampling pulses to secondary clock signals which are the same as or different from the primary clock signals, and outputs phase-adjusted pulses which are the primary sampling pulses after the phase adjustment. In the figure, the phase adjusting unit 3 performs the phase adjustment of the primary sampling pulses according to the secondary clock signals.

A primary switch group 4 is connected to each output stage of the phase adjusting unit 3 and performs the switching operation in accordance with the phase-adjusted pulse, and samples the primary clock signals or the secondary clock signals to successively generate the secondary sampling pulses. In the figures, the secondary clock signals are sampled to generate the secondary sampling pulses. The secondary switch group 5 is connected to one end of each of the signal lines, performs the switching operation in accordance with the secondary sampling pulse and supplies the input video signals to the signal lines 5.

Figure 7:
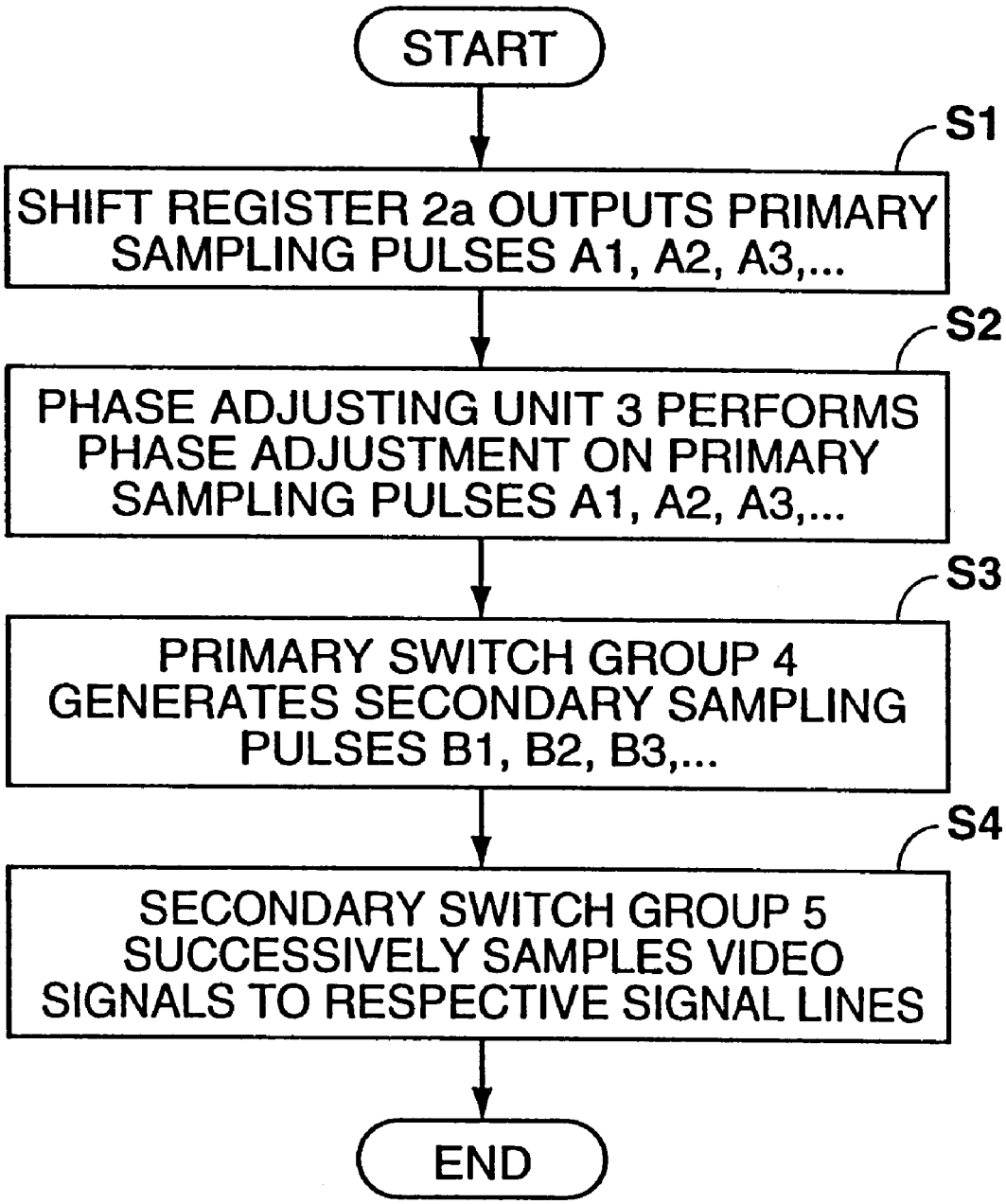
FIG. 7 is a flowchart showing the operation flow of the active matrix display device.

Next, the operation will be described. FIG. 7 is a flowchart showing the operation flow of the active matrix display device.

[S1] The shift register 2*a* operates in accordance with the primary clock signals input from the external to successively output the primary sampling pulses.

[S2] The phase adjusting unit 3 performs the phase adjustment on the primary sampling pulses based on the secondary clock signals which are the same as or different from the primary clock signals, and outputs the phase-adjusted pulses which are the primary sampling pulses after the phase adjustment.

[S3] The primary switching group 4 is connected to each output stage of the phase adjusting unit 3, performs the switching operation in accordance with the phase adjusted sampling pulse and samples the secondary clock signals which are the same as or different from the primary clock signals, thereby successively generating the secondary sampling pulses.

[S4] The secondary switching group 5 is connected to one end of each signal line S and performs the switching operation in accordance with the primary sampling pulses to successively sample the video signals input from the external to the respective signal lines.

Next, the detailed construction of the active matrix display device according to the present invention will be described.

Figure 8:
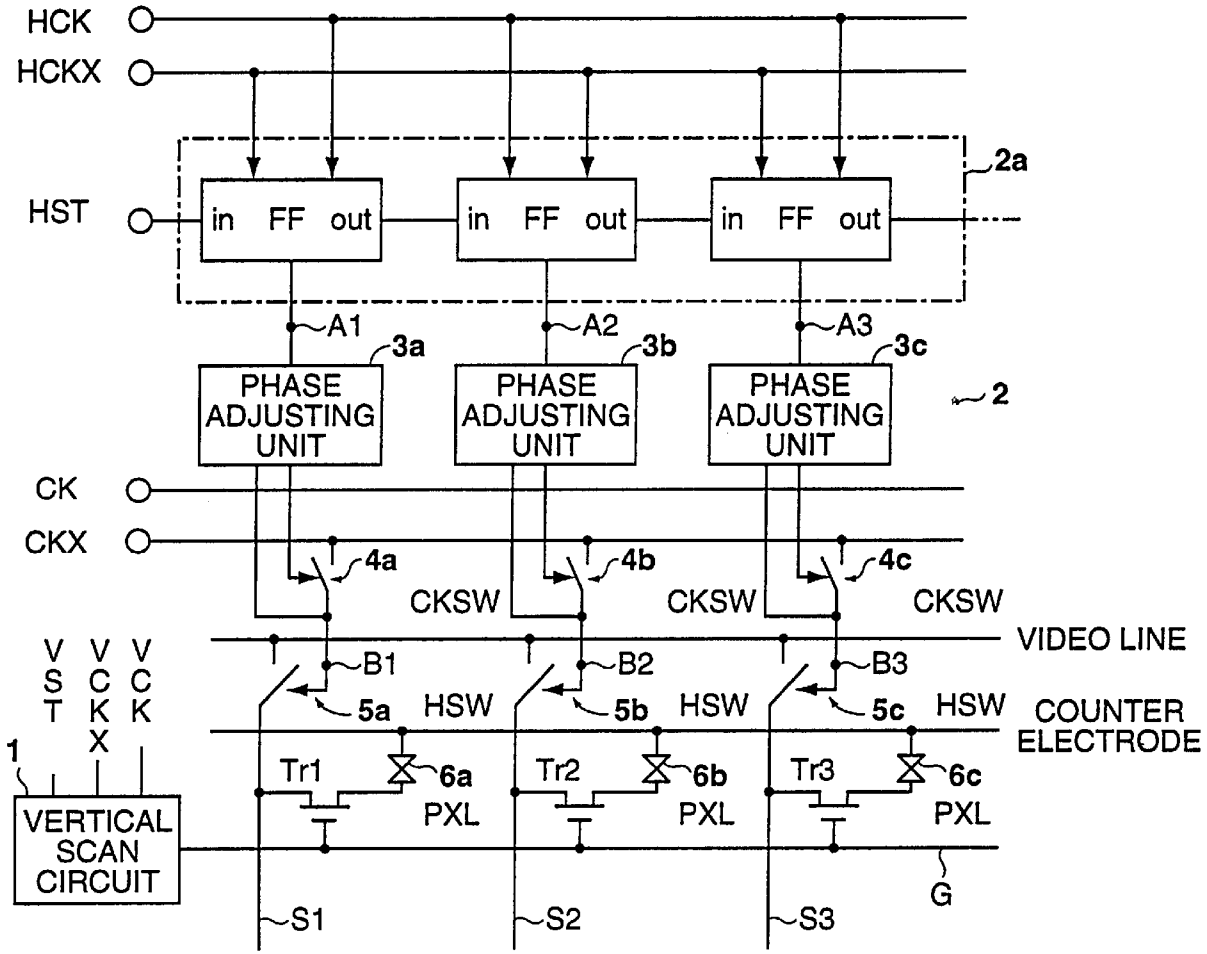
FIG. 8 is a diagram showing the active matrix display device.

FIG. 8 is a diagram showing the construction of the active matrix display device. The active matrix display device includes gate lines G arranged on rows, signal lines S1, S2, S3, . . . arranged on columns, and matrix-arranged pixels PXL 6*a*, 6*b*, 6*c* . . . which are arranged at the intersecting portions therebetween. Thin film transistors Tr1, Tr2, Tr3, . . . are formed as switching elements at the respective intersecting portions.

The gate electrode of each of the thin film transistors Tr1, Tr2, Tr3, . . . is connected to the corresponding gate lines G, the source electrode is connected to the corresponding signal line S1, S2, S3, . . . , and the drain electrode is connected to the corresponding pixel PXL 6*a*, 6*b*, 6*c* . . . Further, the pixel PXL 6*a*, 6*b*, 6*c* . . . comprises a fine liquid crystal cell, and the liquid crystal cell is formed of liquid which is held between a pixel electrode and a counter electrode.

Further, the active matrix display device contains a vertical scan circuit 1 and a horizontal scan circuit 2. The vertical scan circuit 1 successively scans the gate lines G on a line basis to select pixels PXL 6*a*, 6*b*, 6*c* . . . of one row every horizontal period. Specifically, the vertical scan circuit 1 operates in accordance with the vertical clock signals VCK and VCKX which are input from the external and are opposite in phase to each other, and successively transfers the vertical start signals VST supplied from the external to output the selected pulse to each gate line G every horizontal period to thereby keep the thin film transistor Tr1, Tr2, Tr3, . . . on the same line in a conductive state.

The horizontal scan circuit 2 successively samples the video signals from the video line to the respective signal lines S1, S2, S3, . . . within one horizontal period to successively write the video signals into the selected pixels PXL of one row. The horizontal scan circuit 2 has a shift register 2*a* in which flip flops FF are connected in multistage.

The shift register 2*a* operates in accordance with a pair of horizontal clocks HCK, HCKX (primary clock signals) which are input from the external and are opposite in phase to each other, and successively transfers horizontal start signals HST supplied from the external to successively output the primary sampling pulses A1, A2, A3, at . . . every stage.

The phase adjusting unit 3*a*, 3*b*, 3*c* . . . performs the phase adjustment on the primary sampling pulses A1, A2, A3, . . . to CK, CKX (secondary clock signals) which are the same as or different from HCK, HCKX, and outputs the phase-adjusted pulses which are the primary sampling pulses after the phase adjustment.

Plural clock switches CKSW 4*a*, 4*b*, 4*c*, . . . (primary switch group) are connected to the respective output stages of the phase adjusting unit 3, and perform the switching operation in accordance with the primary sampling pulses A1, A2, A3, . . . to sample CK, CKX which are the same as or different from HCK, HCKX, and successively generate the secondary sampling pulses B1, B2, B3, . . .

Plural horizontal switches HSW 5*a*, 5*b*, 5*c*, . . . (secondary switch group) are connected to ends of the respective signal lines S1, S2, S3, . . . , and operate in accordance with the secondary sampling pulses B1, B2, B3, . . . to successively sample the video signal input from the external to the respective signal lines.

Figure 9:
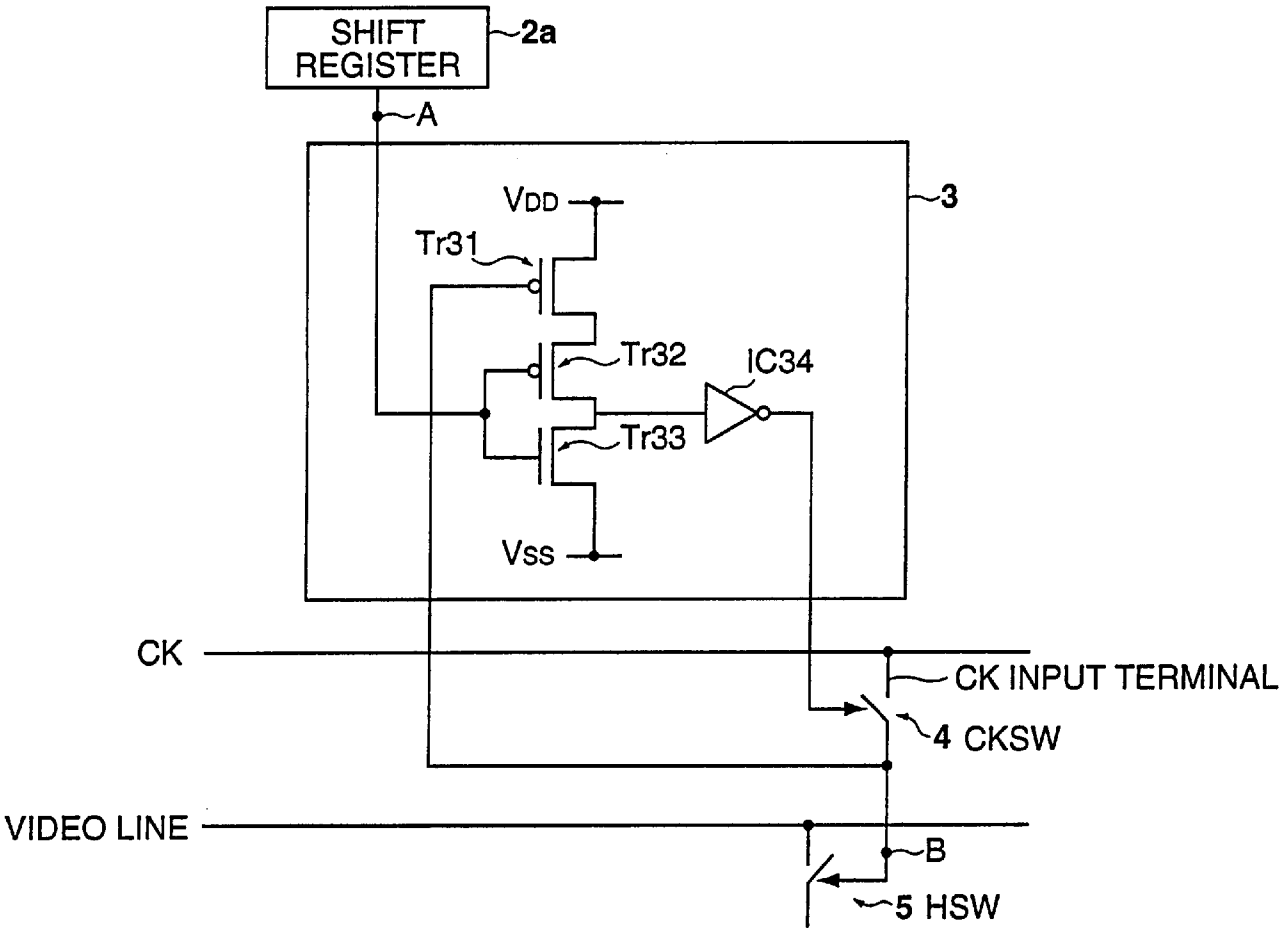
FIG. 9 is a diagram showing a phase adjusting unit.

Next, the phase adjusting unit 3 will be described in detail. FIG. 9 is a diagram showing the internal construction of the phase adjusting unit 3. The phase adjusting unit 3 comprises P-MOS thin film transistors Tr31 and Tr32, an N-MOS thin film transistor Tr 33, and an inverter IC 34.

The source electrode of Tr31 is connected to VDD, and the gate electrode is connected to the output terminal of CKSW 4. The drain electrode is connected to the source electrode of Tr 32.

The gate electrode of Tr 32 is connected to the output of the shift register 2*a*, and the drain electrode is connected to the drain electrode of Tr 33.

The gate electrode Tr 33 is connected to the output of the shift register 2*a*, and the source electrode is connected to VSS.

The input terminal of the inverter IC 34 is connected to the drain electrode of Tr 32 and the drain electrode of Tr 33. The output terminal serves as a CKSW switch terminal.

Figure 10:
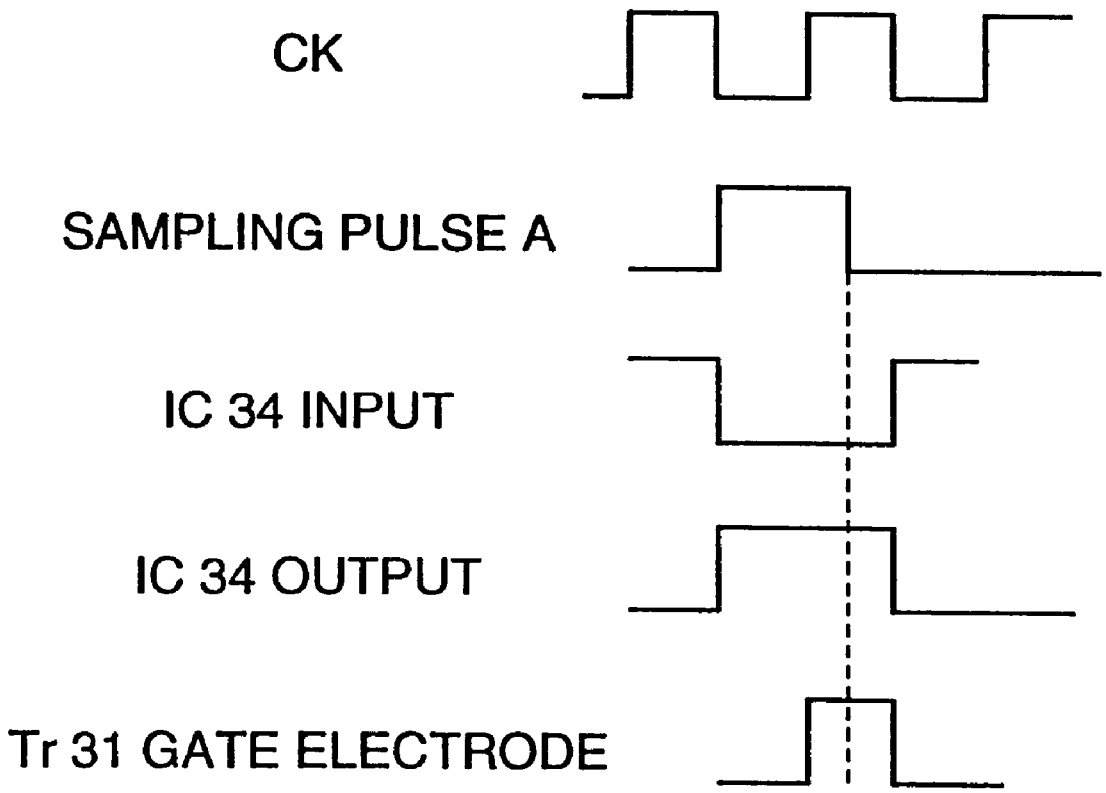
FIG. 10 is a timing chart showing the operation of the phase adjusting unit.

Next, the operation will be described. FIG. 10 is a timing chart showing the operation of the phase adjusting unit 3. The sampling pulse A is assumed to have such a phase as shown in the figure to CK. First, from the leading edge of the sampling pulse A until the trailing edge of the sampling pulse A, Tr 33 is switched on, the input of the inverter IC 34 is set to L and the output of the inverter 34 is set to H. Further, the switch is connected to the CK input terminal, CK is input to the gate electrode of the Tr 31.

At the trailing edge of the sampling pulse A, Tr 32 is switched on and Tr 33 is switched off, but Tr 31 is switched off, so that the input of the inverter IC 34 continues to be conductive even subsequently to the trailing edge of the sampling pulse A.

At the trailing edge of the gate electrode of Tr 31, Tr 31 is switched on. Tr 32 has been already switched on and Tr 33 has been switched off, so that the input of the inverter IC 34 is set to H. Accordingly, the output of the inverter IC 34, that is, the phase-adjusted pulse becomes a pulse of H with which a CK pulse contained in the sampling pulse A can be sufficiently taken out, and the sampling pulses B1, B2, B3, . . . are generated from the phase-adjusted pulse.

As described above, the active matrix display device of the present invention is provided with the phase adjusting unit 3 for performing the phase adjustment on the primary sampling pulses A1, A2, A3, . . . to generate the secondary sampling pulses B1, B2, B3, . . . Therefore, the dispersion of the secondary sampling pulses B1, B2, B3, . . . can be suppressed, so that defects such as the reduction of the resolution, ghost, etc. can be improved.

As described above, the active matrix display device of the present invention is provided with a phase adjusting unit for performing the phase adjustment on the primary sampling pulses to generate the secondary sampling pulses, whereby the dispersion of the secondary sampling pulses can be suppressed, and the defectives such as the reduction of the resolution, the ghost, etc. can be improved. Therefore, high-quality images can be displayed.

What is claimed is:

1. An active matrix display device including:

a pixel unit including gate lines, signal lines and pixels which are arranged at respective intersecting portions of said gate lines and said signal lines;

a vertical scan circuit for successively scanning said gate lines to select one row of pixels every horizontal period;

a horizontal scan circuit for supplying video signals to the signal lines to write the video signals in the pixels of the selected row, said horizontal scan circuit having a shift register which operates in accordance with a primary clock signal to output primary sampling pulses;

a phase adjusting unit for performing phase adjustment on the primary sampling pulses in accordance with a secondary clock signal to output phase-adjusted pulses;

a primary switch group which is connected to output stages of said phase adjusting unit and which performs a switching operation in accordance with the phase-adjusted pulses to sample the primary clock signal or the secondary clock signal and generate secondary sampling pulses; and a secondary switch group which is connected to one end of each of said signal lines and performs a switching operation in accordance with the secondary sampling pulses to supply the video signals to said signal lines.

2. The active matrix display device as claimed in claim 1, wherein the primary clock signal is identical to the second clock signal.

3. The active matrix display device as claimed in claim 1, wherein the secondary clock signal is different from the primary clock signal.

4. The active matrix display device as claimed in claim 1, wherein said pixel unit, said horizontal scan circuit, said phase adjustment unit and said primary and secondary switch groups are formed on the same substrate.

5. The active matrix display device as claimed in claim 4, wherein said pixel unit and said vertical scan circuit are formed on the same substrate.

6. The active matrix display device as claimed in claim 1, wherein said horizontal scan circuit, said phase adjustment unit and said primary and secondary switch groups are constructed with thin film transistors which are formed on an insulating substrate.

7. The active matrix display device as claimed in claim 1, wherein each of said pixels has a pixel transistor which is connected to a pixel electrode.

8. The active matrix display device as claimed in claim 7, wherein said pixel transistor is formed of a thin film transistor which is formed on an insulating substrate.

9. An active matrix display device including:

a display unit including gate lines, signal lines and pixels which are arranged at respective intersections of said gate lines and said signal lines;

a vertical scan circuit for successively scanning said gate lines to select one row of pixels along a gate line every horizontal period;

a horizontal shift register which operates in accordance with a primary clock signal to output primary sampling pulses;

a phase adjusting unit for phase adjusting the primary sampling pulses in accordance with a secondary clock signal to output phase-adjusted sampling pulses; and a horizontal scan circuit for supplying video signals to the signal lines to write the video signals in the pixels of the selected row in response to said phase-adjusted pulses.

10. The display device of claim 9, wherein said horizontal scan circuit further comprises:

a primary switch group which is connected to output stages of said phase adjusting unit and which performs a switching operation in accordance with said phase-adjusted pulses to sample said primary clock signal or said secondary clock signal; and a secondary switch group which is connected to one end of each of said signal lines and which performs a switching operation in accordance with said secondary sampling pulses to supply the video signals to said signal lines.

11. The display device of claim 9, wherein said phase adjusting unit comprises a separate phase adjusting unit corresponding to each signal line.

12. The display device of claim 9, wherein each of said phase adjusting units comprises a first, second and third transistors, wherein said first and second transistors and P-MOS transistors and said third transistor is an N-MOS transistor.

13. The display device of claim 12, wherein:

a drain of said first transistor is connected to a source of said second transistor; and a drain of said second transistor is connected to a drain of said third transistor at a first node.

14. The display device of claim 13, further comprising an inverter connected between said first node and a clock switch, a signal from said inverter being used to control said clock switch which selectively provides said secondary clock signal to a gate of said first transistor.

15. The display device of claim 14, wherein one of said primary sampling pulses is provided to gates of said second and third transistors.

16. An active matrix display device including:

a display means including gate lines, signal lines and pixel means for generating individual elements of an image being displayed, said pixel means being arranged at respective intersections of said gate lines and said signal lines;

a vertical scanning means for successively scanning said gate lines to select one row of pixels means along a gate line every horizontal period;

a means for outputting primary sampling pulses in accordance with a primary clock signal;

a phase adjusting means for phase adjusting the primary sampling pulses in accordance with a secondary clock signal to output phase-adjusted sampling pulses; and a horizontal scanning means for supplying video signals to the signal lines to write the video signals in the pixel means of the selected row in response to said phase-adjusted pulses.

* * * * *